United States Patent [19]

Miller

[11] 4,359,873

[45] Nov. 23, 1982

[54] COOLING ASPHALTIC STRIP MATERIAL

[75] Inventor: Donald R. Miller, Newark, Ohio

[73] Assignee: Owens-Corning Fiberglas Corporation, Toledo, Ohio

[21] Appl. No.: 278,534

[22] Filed: Jun. 29, 1981

[51] Int. Cl.[3] ..... F25D 13/06

[52] U.S. Cl. ..... 62/63; 34/13; 62/374

[58] Field of Search ..... 62/63, 64, 374, 375, 62/380; 34/13, 23

[56] References Cited

U.S. PATENT DOCUMENTS

| | | | |
|---|---|---|---|
| 1,999,832 | 4/1935 | Dreffein | 62/171 |
| 2,274,284 | 2/1942 | Vore | 62/63 |
| 2,338,054 | 12/1943 | O'Neil | 62/63 |
| 2,365,352 | 12/1944 | Moffitt | 34/13 |
| 2,776,544 | 1/1957 | Schulerud | 62/375 |
| 3,116,788 | 1/1964 | Beggs et al. | 165/120 |
| 3,262,688 | 7/1966 | Beggs | 266/113 |
| 3,267,585 | 8/1966 | Futer | 62/380 |
| 3,664,146 | 5/1972 | Butts | 62/63 |

OTHER PUBLICATIONS

Kercher, D. M. Tabakoff, W., "Heat Transfer By A Square Array Of Round Air Jets Impinging Perpendicular To A Flat Surface Including Effect Of Spent Air" ASME, Jour. Eng. Power, vol. 92, p. 73 (1970).

*Primary Examiner*—Ronald C. Capossela

*Attorney, Agent, or Firm*—Ronald C. Hudgens; Philip R. Cloutier; Ted C. Gillespie

[57] ABSTRACT

A method and apparatus for cooling a continuously moving strip of asphaltic material includes directing the asphaltic material into a plurality of loops having lengths and widths, spraying an evaporative liquid onto the asphaltic material from spraying means positioned upstream from various ones of the lengths, and evaporating the evaporative liquid immediately downstream from each of the spraying means by causing an array of air jets to impinge on the asphaltic material substantially normally to the lengths.

13 Claims, 5 Drawing Figures

COOLING ASPHALTIC STRIP MATERIAL

TECHNICAL FIELD

This invention pertains to the handling of continuous strips of asphaltic material, such as asphaltic material suitable for use as roofing membranes and roofing shingles. In one of its more specific aspects, this invention relates to the cooling of the asphaltic strip material in the production process.

BACKGROUND OF THE INVENTION

A common method for the manufacture of asphalt shingles is the production of a continuous strip of asphaltic shingle material followed by a shingle cutting operation which cuts the continuous strip into individual shingles. In the production of asphaltic strip material, either an organic felt or a glass fiber mat is passed through a saturator, containing liquid asphalt at a very hot temperature, to form a saturated asphaltic strip. Subsequently, the hot asphaltic strip is passed beneath a granule applicator which applies the protective surface granules to portions of the asphaltic strip material. In conventional shingle processes, the hot asphaltic strip material is next directed toward a cooling section where the asphaltic strip is held in the form of numerous loops. The cooling section of existing processes acts as an accumulator or temporary storage means for the asphaltic strip prior to shingle cutting and packaging. The asphaltic strip is maintained in the cooling section for a short period of time during which the asphaltic strip is cooled by the effects of the factory air acting on the loops. Some production processes provide for fans for blowing factory air through the loops, in a direction generally parallel to the lengths of material in the loops, and generally perpendicular to the machine direction of the shingle production machine. Some production processes use a water spray to wet the asphaltic strip prior to the blowing of air through the loops.

One of the problems associated with existing shingle production processes is that during the summer months, when factory air is at elevated temperatures and can be well over 100° F., the cooling section is insufficient to cool the asphaltic strip to the degree required for proper cutting and packaging of the shingles. This is especially true in relatively warm climates, such as the southern portion of the United States. If the asphaltic strip is too hot, the shingle cutting operation is adversely affected. Also the shingle packaging operation becomes less efficient when the shingles are too hot, and hot shingles become a greater fire hazard once they are packaged. As new technology is applied to existing shingle production facilities, the speed with which the continuous asphaltic strip can be produced is increased. Thus, it has been found that in many cases the limiting factor in increasing the speed and the efficiency of a shingle production machine is the ability to cool and dry the asphaltic strip prior to cutting and packaging.

One of the attempts to solve the problem of cooling asphaltic strip material is disclosed in U.S. Pat. No. 2,365,352, to Moffitt. Moffitt describes a continuous asphaltic strip production process in which the cooling section contains a single water spray means for spraying water onto the loops of shingles as the loops are formed in the cooling section. Moffitt also provides for blowing cooling air through the loops, in a direction parallel to the strip material, while the loops are in the cooling section. Moffitt's solution to the asphaltic strip cooling problem is disadvantageous in that the air flow is not perpendicular or normal to the asphaltic strip material and is, therefore, relatively inefficient. The relatively inefficient nature of Mofitt's cooling system necessitates a rather lengthy cooling section in the machine direction. Also, in part due to the inefficiency of the air flow, Mofitt's system requires an enclosed cooling section, which greatly increases the capital expense of the apparatus.

SUMMARY OF THE INVENTION

There has now been developed a method and apparatus for solving the problem of cooling asphaltic strip material in a short amount of space in the machine direction and with a high degree of efficiency. The invention provides for the use of repeated applications of spraying an evaporative liquid such as water onto the asphaltic material, with each application of evaporative liquid being followed by air jets impinging onto the asphaltic strip material in a direction normal to strip material to evaporate the liquid, thereby cooling and drying the strip material.

According to this invention, there is provided apparatus for cooling a continuously moving strip of asphaltic material comprising means for directing the asphaltic material into a plurality of loops having lengths and widths, spraying means positioned upstream from various ones of the lengths for spraying an evaporative liquid onto the asphaltic material, and air delivery means positioned immediately downstream from each of the spraying means for evaporating the evaporative liquid, each of the air delivery means being adapted to cause an array of air jets to impinge on the asphaltic material substantially normally to the lengths.

In a specific embodiment of the invention, the lengths of the loops are generally vertical.

In another embodiment of the invention, the air delivery means are adapted to deliver air at a controlled rate so that the force of the air jets from air delivery means supplying arrays to opposite sides of a single length of asphaltic material can be balanced.

In another embodiment of the invention, each of the air delivery means is comprised of a plenum defined by an orificed plate which is generally parallel the lengths and through which the arrays are directed.

In a preferred embodiment of the invention, the orifices are round.

In a more preferred embodiment of the invention, the air delivery means are adapted to supply the arrays to substantially the entire height of the lengths.

In the most preferred embodiment of the invention, more than one of the air delivery means is positioned downstream from the furthest downstream spraying means.

According to this invention, there is also provided a method for cooling a continuously moving strip of asphaltic material in which the asphaltic strip material is directed into a plurality of loops having lengths and widths, an evaporative liquid is sprayed onto the asphaltic material from spraying means positioned upstream from various ones of the lengths, and the evaporative liquid is evaporated immediately downstream from each of the spraying means by causing an array of air jets to impinge on the asphaltic material substantially normally to the lengths.

In a specific embodiment of the invention, the arrays of air jets are discharged from plenums positioned between the lengths.

In another embodiment of the invention, the forces of the air jets impinging on opposite sides of the lengths are balanced.

In a preferred embodiment of the invention, the arrays are supplied to substantially the entire height of the lengths.

In the most preferred embodiment of the invention, arrays of air jets are directed toward more than one of the lengths downstream from the furthest downstream spraying means.

DESCRIPTION OF THE INVENTION

Figure 1:
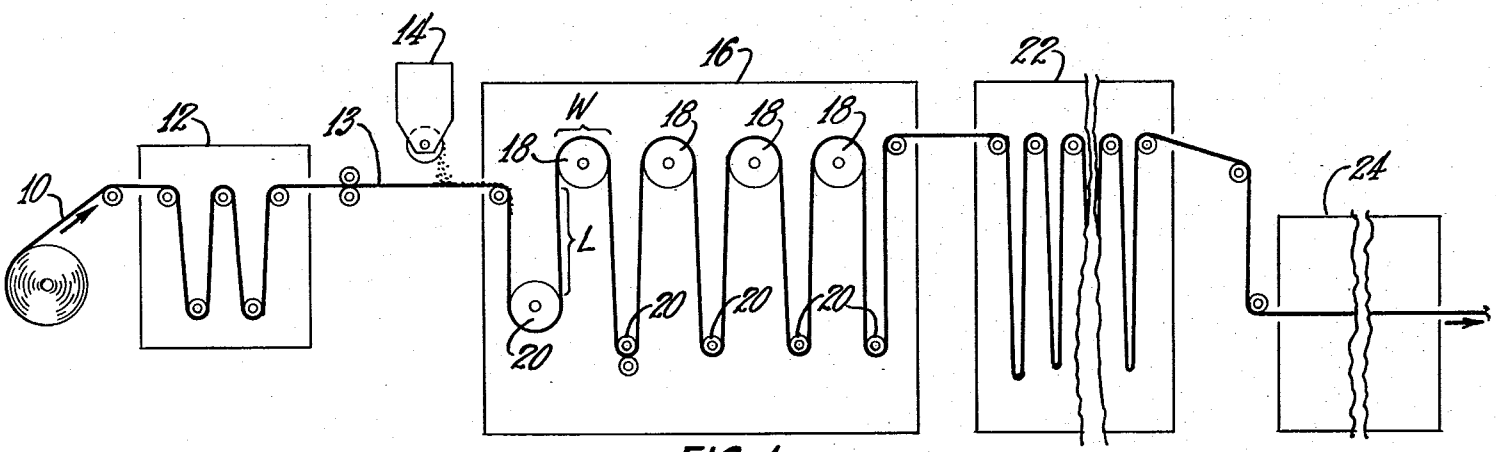
FIG. 1 is a schematic cross-sectional view in elevation of apparatus for producing asphaltic strip material according to the principals of this invention.
Figure 5:
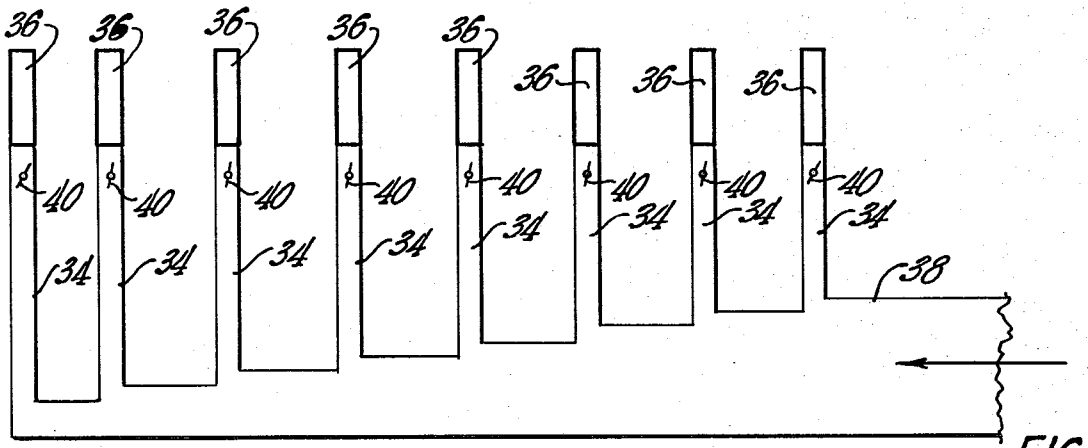
FIG. 5 is a schematic view in elevation of the means for supplying air to the air delivery means of the invention.

As shown in FIG. 1, base sheet 10, which can be an organic felt or a glass fiber mat, is passed through saturator 12 containing liquid asphalt to create continuous hot strip 13 of asphaltic material. The hot asphaltic strip can then be passed beneath granule applicator 14 which applies the surface coating granules to a portion of the asphaltic strip. Subsequently, the asphaltic strip is passed through cooling section 16 where it is cooled and dried. Within the cooling section, the asphaltic strip can be directed by upper pulleys 18 and lower pulleys 20 into a plurality of loops having lengths L and widths W. Preferably, the lengths are generally vertical. After passing through the cooling section, the cooled and dried asphaltic strip can be directed into temporary storage looper 22 which accumulates the asphaltic strip prior to its delivery to shingle cutter 24, and packaging operations, not shown.

Figure 2:
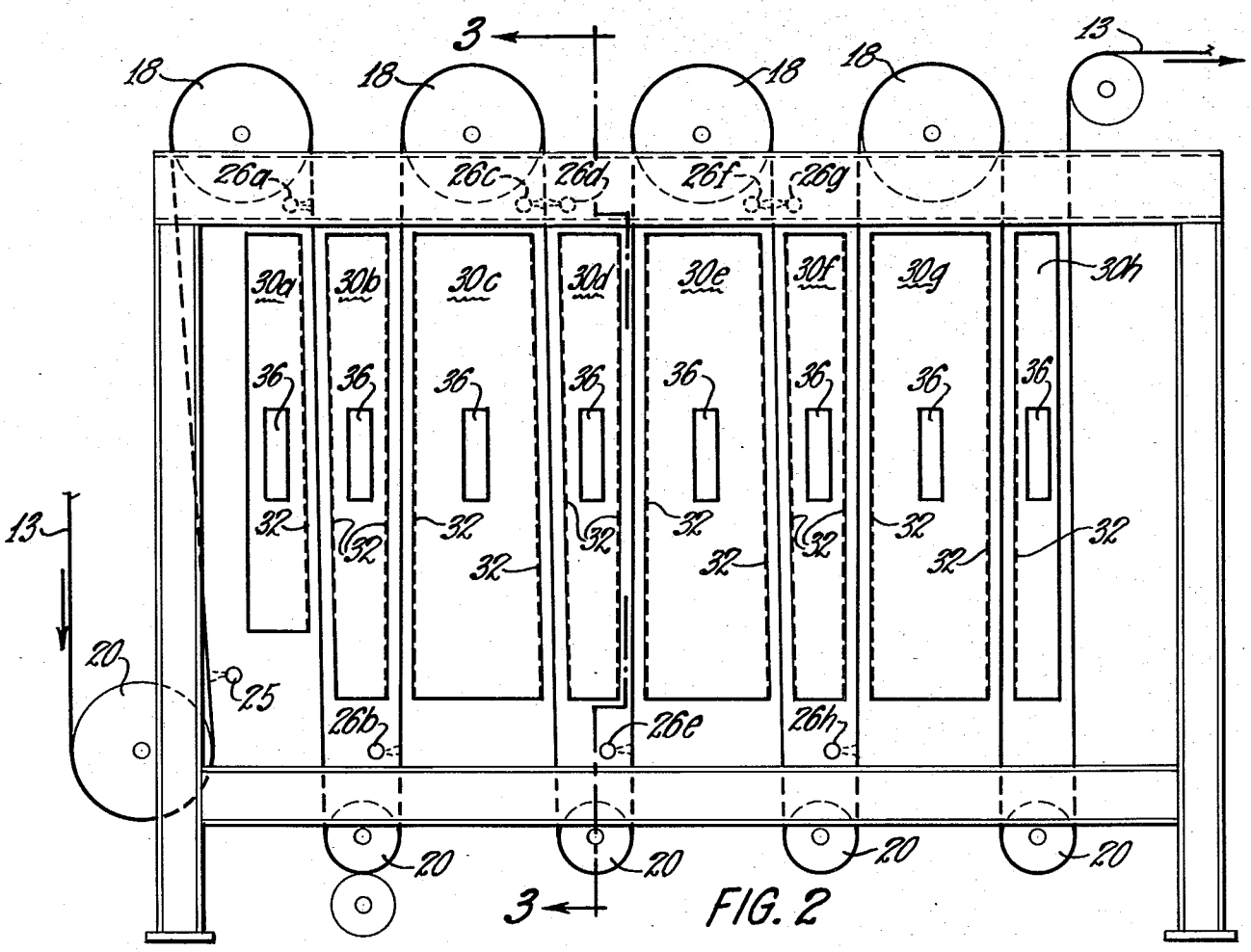
FIG. 2 is a schematic cross-sectional view in elevation of the cooling section of the production machine of FIG. 1.
Figure 3:
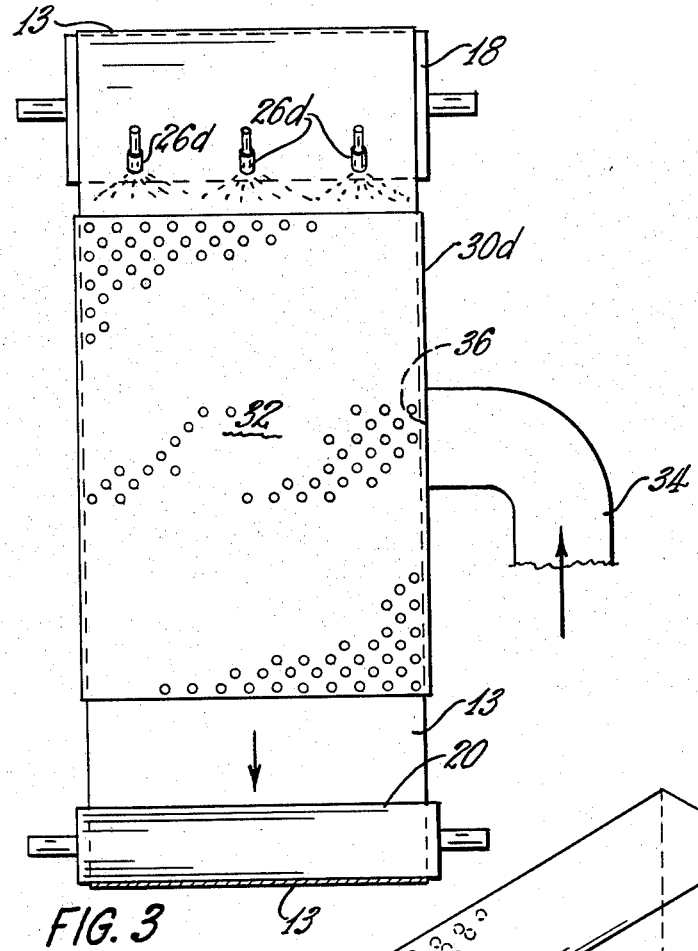
FIG. 3 is a schematic vertical section on line 3—3 of FIG. 2.

As shown in FIG. 2, an initial means for applying water to the asphaltic strip as it enters the cooling section, such as nozzle 25, can be positioned at the entrance of the cooling section. The water from this nozzle flashes to steam during normal operation due to the high temperature of the asphaltic strip. Spraying means, such as nozzles **26*a* through 26*h*, are positioned upstream from various ones of the vertical lengths of the loops for spraying an evaporative liquid, such as water, onto the asphaltic material. As shown in FIG. 3**, the spraying means can be comprised of a series of three nozzles positioned across the width of the continuous strip of asphaltic material. The nozzles are supplied from a source of evaporative liquid, not shown.

Figure 4:
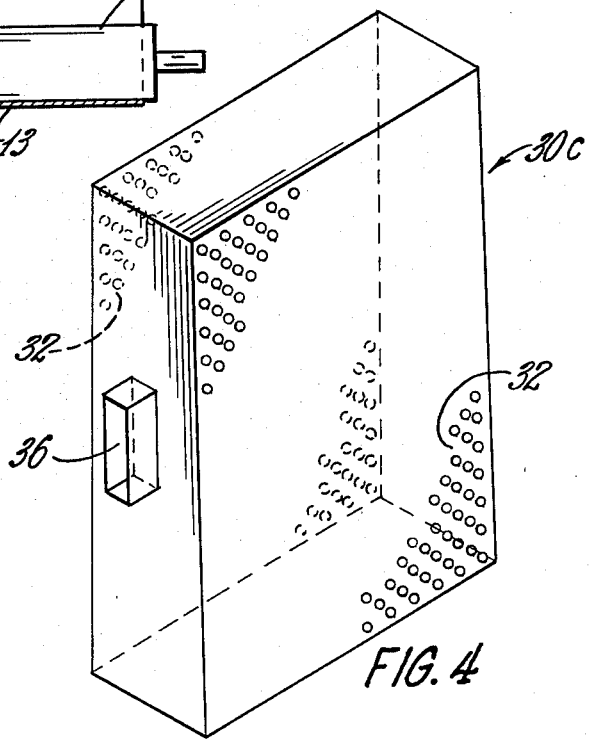
FIG. 4 is a perspective view of an air delivery means according to the principles of the invention.

Positioned immediately downstream from each of the nozzles **26*a* through 26*h* are air delivery means 30*a* through 30*h* for evaporating the water on the strip material immediately downstream from each of the nozzles. As shown in FIGS. 2 and 3, associated with each loop is a cooling unit comprised of a set of nozzles for spraying water immediately followed by an air delivery means for evaporating the water. Thus, a series or plurality of cooling units carries out a plurality of cooling cycles on the strip material, each cycle having a water spraying step immediately followed by an evaporation step. Each of the air delivery means is comprised of a plenum defined by orificed plates 32 which are generally parallel to the lengths of asphaltic material in the loops. Preferably, the orifices in the plates are round, and deliver arrays of column-like air jets. Also, the orifices of the orificed plates preferably extend along the entire height of the plenums so that the arrays are supplied from the plenums over substantially the entire height of the lengths of the loops, as shown in FIGS. 3 and 4**. Air passing from the plenums through the orificed plates causes an array of air jets to impinge on the asphaltic material substantially normally to the lengths of asphaltic material. The impingement of the air jets in a direction normal to the surface to be cooled facilitates the rapid and efficient cooling of the asphaltic strip. Preferably, the impinging air jets supply air at a rate within the range of from about 60 to about 70 cfm per square foot of plenum surface.

As shown in FIGS. 2 through 5, the air can be supplied to the plenums by branch conduits 34, each terminating in air conduit outlets 36 positioned in the plenums. The branch conduits can be supplied with air for cooling and drying via main air supply duct 38, which can be supplied from a source not shown. The branch conduits can be adapted with any suitable means for controlling the flow of air therethrough, such as dampers 40 in order to balance the force of the arrays of air jets impinging on opposite sides of the lengths. For example, the length of asphaltic material downstream from spray nozzle **26*b*, which is positioned between plenums 30*b* and 30*c***, is subject to the force of the arrays of air jets impinging thereupon from those two plenums. To avoid undesirable contact between the asphaltic material and the orificed plate, the forces of the opposed arrays must be balanced. The dampers in the branch conduits enable the forces applied by the arrays to be balanced.

As shown in FIG. 2, more than one plenum can be positioned downstream from the furthest downstream nozzle. For example, as shown in FIG. 2, positioned downstream from nozzle **26*h*, which is the furthest downstream nozzle, are two plenums, 30*g* and 30*h***, which facilitate the drying of the ashaltic material to a completely dry condition.

INDUSTRIAL APPLICABILITY

This invention will be found to be useful in the continuous production of asphaltic strip material for such uses as asphalt shingles.

I claim:

1. Apparatus for cooling a continuously moving strip of asphaltic material comprising means for directing said asphaltic material into a plurality of loops having lengths and widths, and a plurality of cooling units, each of said cooling units being associated with one of said loops, each cooling unit comprising:

a. spraying means positioned to spray evaporative liquid onto the asphaltic material in the loop; and b. air delivery means positioned immediately downstream from said spraying means and adapted to cause an array of air jets to impinge on the asphaltic material substantially normally thereto to evaporate said evaporative liquid from the asphaltic material in the loop.

2. The apparatus of claim 1 in which each of said air delivery means is comprised of a plenum defined by an orificed plate.

3. The apparatus of claim 2 in which said orificed plate is generally vertical.

4. The apparatus of claim 2 in which said air delivery means are adapted to deliver air at a controlled rate so that the force of the air jets from air delivery means supplying arrays to opposite sides of said asphaltic material can be balanced.

5. The apparatus of claim 2 in which the orifices in said orificed plate are round.

6. The apparatus of claim 2 in which said air delivery means are adapted to supply said arrays to substantially the entire height of said lengths.

7. The apparatus of claim 6 comprising more than one of said air delivery means positioned downstream from the furthest downstream spraying means.

8. A method for cooling a continuously moving strip of asphaltic material comprising subjecting said asphaltic material to a plurality of cooling cycles, each cooling cycle comprising:

a. spraying evaporative liquid onto said asphaltic material from a means for spraying; and b. evaporating said evaporative liquid immediately downstream from said means for spraying by causing an array of air jets to impinge on said asphaltic material substantially normally to said asphaltic material.

9. A method for cooling a continuously moving strip of asphaltic material comprising directing said asphaltic material into a plurality of loops having lengths and widths and subjecting said asphaltic material to a plurality of cooling cycles, each cooling cycle being associated with one of the loops, and each cooling cycle comprising:

a. spraying evaporative liquid onto the asphaltic material in a loop from a means for spraying; and b. evaporating said evaporative liquid immediately downstream from said means for spraying by causing an array of air jets to impinge on said asphaltic material substantially normally to said asphaltic material in the loop.

10. The method of claim 9 comprising discharging said array of air jets from plenums positioned between said lengths.

11. The method of claim 10 comprising balancing the force of the air jets impinging on opposite sides of said lengths.

12. The method of claim 11 comprising supplying said arrays to substantially the entire height of said lengths.

13. The method of claim 12 comprising directing said arrays of air jets toward more than one of said lengths downstream from the furthest downstream spraying means.

* * * * *